US005125521A

United States Patent [19]

Somogyi

[11] Patent Number: 5,125,521

[45] Date of Patent: Jun. 30, 1992

[54] PERFUME BOTTLE WITH REUSABLE HOUSING

[75] Inventor: Stephens Somogyi, Paris, France

[73] Assignee: D. Swarovski & Co., Wattens, Austria

[21] Appl. No.: 640,207

[22] Filed: Jan. 11, 1991

[30] Foreign Application Priority Data

Jan. 17, 1990 [FR] France ..... 90 00480

[51] Int. Cl.[5] ..... A45D 34/02; B65D 23/08

[52] U.S. Cl. ..... 215/12.1; 215/10; 206/485; 206/514; 220/410; 220/411; 220/469

[58] Field of Search ..... 206/485, 514; 215/11.6, 215/12.1, 12.2, 10; 220/737, 468, 469, 410, 411

[56] References Cited

U.S. PATENT DOCUMENTS

| | | | |
|---|---|---|---|
| 416,355 | 12/1889 | Chalk | 215/11.6 |
| 535,550 | 3/1895 | Müller | 215/11.6 X |
| 986,963 | 3/1911 | Breitung | 215/1 R |
| 1,468,808 | 9/1923 | Hamilton | 215/12.1 |
| 1,741,154 | 12/1929 | Hatgney | 215/12.1 |
| 2,093,905 | 9/1937 | Bowen | 215/12.1 |
| 2,328,338 | 8/1943 | Hauptman | 215/12.1 |

FOREIGN PATENT DOCUMENTS

| | | | |
|---|---|---|---|
| 263627 | 8/1913 | Fed. Rep. of Germany | 215/11.1 |
| 666573 | 10/1929 | France | 215/12.1 |
| 1287487 | 2/1962 | France | 215/12.1 |
| 2620913 | 3/1989 | France | 215/10 |
| 1670 | of 0000 | United Kingdom | 215/12.1 |
| 240036 | 9/1925 | United Kingdom | 215/12.1 |

*Primary Examiner*—Sue A. Weaver
*Attorney, Agent, or Firm*—Fish & Richardson

[57] ABSTRACT

A vessel containing perfume is placed in an accommodating space in an outer case consisting of two half shells articulated one upon the other. A cap ensures both that the vessel is tightly closed and that the case is locked in a closed position.

14 Claims, 2 Drawing Sheets

FIG. 3
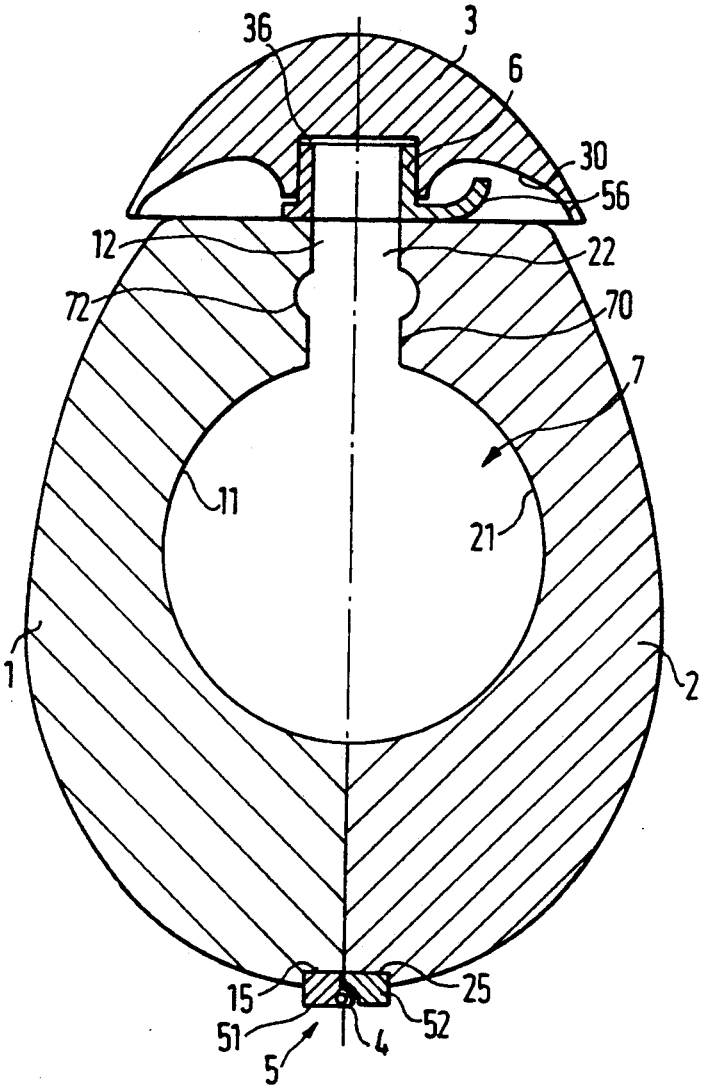
FIG. 5
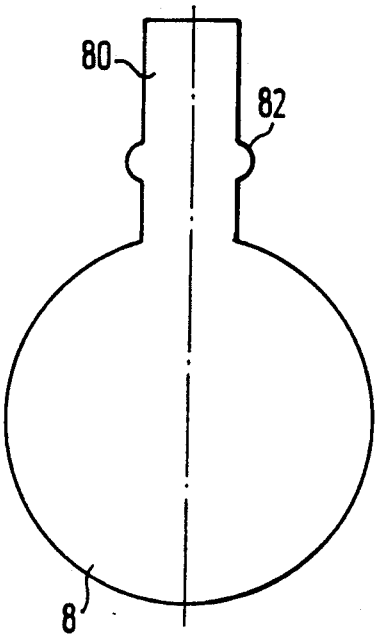
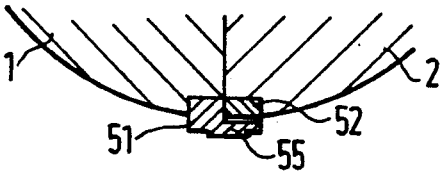
FIG. 4

PERFUME BOTTLE WITH REUSABLE HOUSING

BACKGROUND OF THE INVENTION

1. Field of the Invention

The present invention relates in general to an object that combines utility with beauty. This object of original and novel design, that is realized in very decorative fashion, is a perfume bottle.

2. Discussion of the Related Art

It is known in the field of deluxe perfumes to provide a large range of packaging for perfumes. The perfumes are presented, for example, in luxurious bottles with very elaborate shapes that must be thrown away when they are empty, which one generally regrets doing. There are also strictly functional bottles which are called "refills" and have no decoration. These refill bottles are intended to be housed in a decorative case.

The cases are generally of altogether cylindrical shape and consist of two parts that are screwed together after the refill bottle is placed inside. Such cases are usually made of plastic material or metal.

SUMMARY OF THE INVENTION

The present invention is aimed at proposing a bottle of novel design that offers the designer a great number of possibilities of decoration, and the user a very luxurious object that does not have to be thrown away when empty.

For these purposes, the inventive bottle is characterized by comprising:

a vessel containing the perfume, an outer case having a space for accommodating the vessel and formed of two half shells jointed one upon the other, and a cap ensuring both that the vessel is tightly closed and that the case is locked in a closed position.

Other features of the invention are as follows.

The two half shells are joined together and articulated with each other about an axis tangent with their outer surfaces, said half shells bearing means for holding one against the other in the closed position of the case.

The half shells are substantially symmetrical and the axis is situated substantially on the plane of the opposing faces of said half shells.

The opposing faces are each surrounded by a holding ring.

The two holding rings cooperate by friction in order to constitute the holding means.

One of the holding rings is outside the other and has a skirt forming on its outer surface a decorative ring masking the holding means.

The half shells have a truncated end so as to have flat faces.

The rings have flat portions in contact with the flat faces and bear semicylindrical portions intended to form a piece for the cap to be screwed onto.

At least one of the rings bears on the flat portion a grasping tongue for opening the case.

The half shells each have a recess intended to form the space for accommodating the vessel containing the perfume when the case is closed.

The recesses are prolonged in the direction of the flat faces by channels opening inside the semicylindrical portions, so that in the closed position of the case the accommodating space opens through a hollow cylinder into the screwing piece.

The vessel containing the perfume is placed in the accommodating space and has a neck placed in the cylinder.

The hollow cylinder and the neck have means for relative positioning thereof.

The cap has a threaded bore permitting it to be screwed onto the screwing piece, and a packing provided at the bottom of said threaded bore to ensure a tight closure of the vessel containing the perfume.

The cap is formed with an annular chamber to pass over the grasping tongue.

The half shells are made of a transparent material.

BRIEF DESCRIPTION OF THE DRAWINGS

Other features and advantages of the present invention will become apparent from the following description of an embodiment thereof with reference to the drawings, in which

FIG. 3 is a sectional view of the bottle;

FIG. 4 is a partial sectional view along line IV—IV in FIG. 1;

FIG. 5 shows the vessel containing the perfume.

DETAILED DESCRIPTION OF THE PREFERRED EMBODIMENTS

Figure 1:
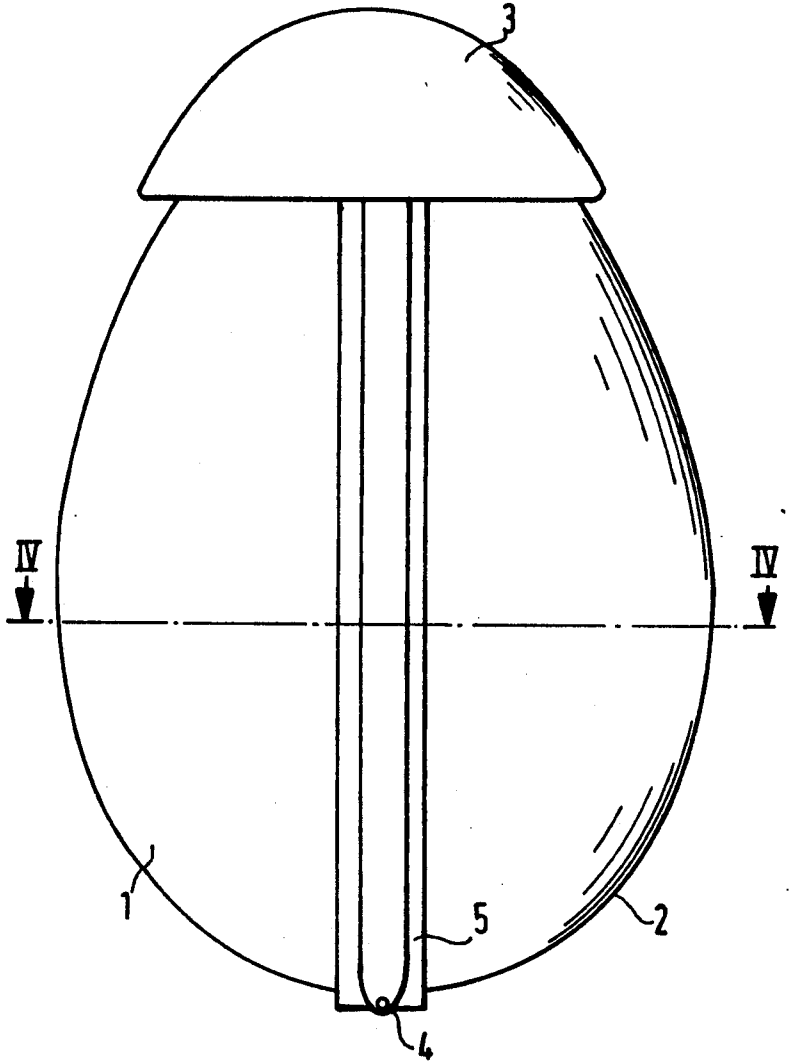
FIG. 1 shows the closed bottle.

FIG. 1 shows the perfume bottle closed; one can see the two substantially symmetrical half shells 1 and 2 forming the outer case, and cap 3.

Half shells 1, 2 are altogether of semioval shape, one end being truncated so as to form flat faces 13, 23. Half shells 1, 2 also have two opposing faces 10, 20 which are flat and intended to be brought in mutual contact when the case is closed. The outer contour of opposing faces 10, 20 is shaped, as seen in FIG. 3, with a platform 15, 25 for mounting holding rings 51, 52.

These rings 51, 52 extend on platforms 15, 25 and have flat portions 57 and 58 in contact with flat faces 13, 23. These flat portions 57, 58 bear like semicylindrical portions 53, 54 threaded on the outer face and intended to form, when the case is closed, threaded piece 6 visible in FIG. 3.

Figure 2:
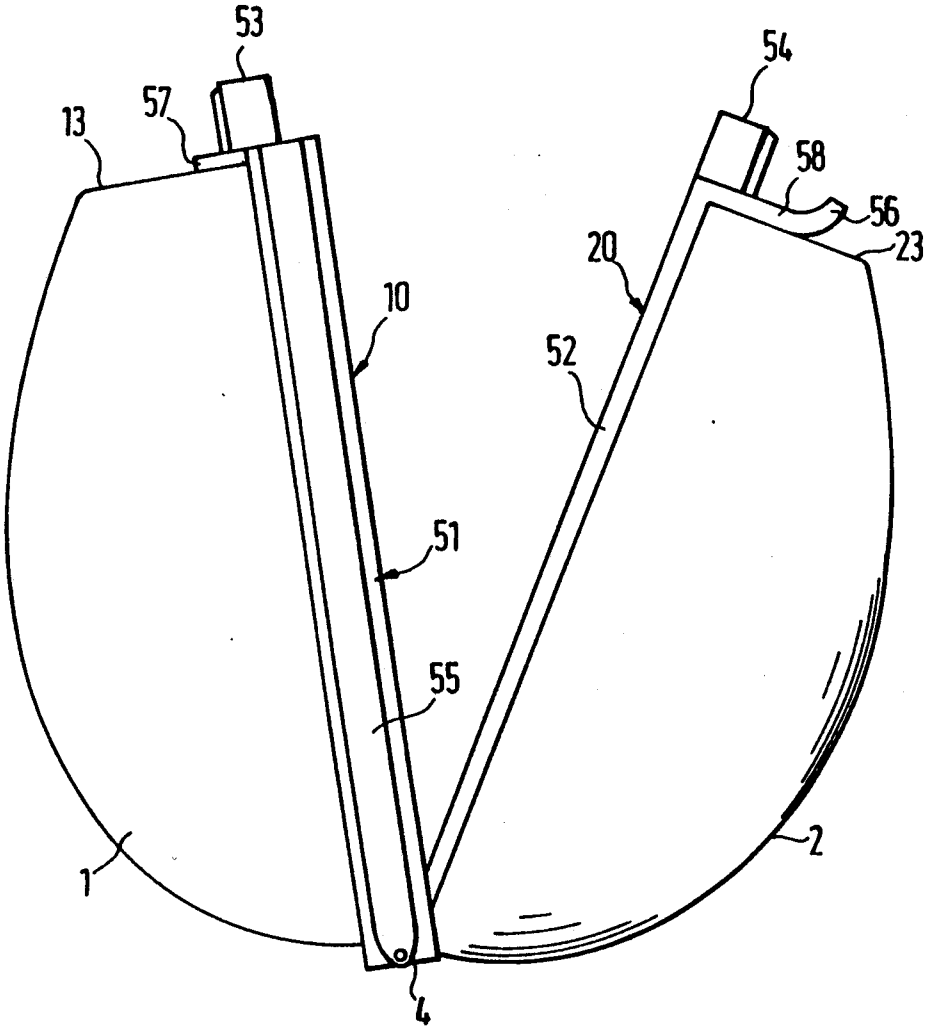
FIG. 2 shows the case in the open position.

Rings 51, 52 are jointed one upon the other about an axis 4 situated substantially in the planes of opposing faces 10, 20 of half shells 1, 2 and tangentially to said half shells 1, 2. This arrangement permits the case to be opened as shown in FIG. 2 while the half shells are kept constantly joined together.

Rings 51, 52 include means ensuring that they are held one against the other and thus that the case formed by the two shells is held closed.

For this purpose, ring 51 is outside ring 52 and has a skirt 55, visible in FIG. 4, which extends in the direction of ring 52 on the periphery of the case outside the areas of axis 4 and flat faces 13, 23.

Skirt 55 and ring 52 are dimensioned such that ring 52 can be positioned inside said skirt and held there by friction.

In order to improve this hold one can, in a manner known as such, provide bulbs on either of rings 51, 52, thereby creating a locking effect.

According to one variant, it is likewise possible to provide a spring positioned about axis 4 holding the two parts of the case in mutual contact.

Flat portion 58 of ring 52 bears a grasping tongue 56 bent upwardly to permit the user to exert a pull on half shell 2 in order to remove half shell 1 and open the case against the holding means.

As visible in FIG. 3, cap 3 is formed with a threaded bore 36 in its center to permit it to be screwed onto piece 6 formed by semicylindrical portions 53, 54 when the case is closed. The cap is likewise formed with an annular chamber 30 to pass about tongue 56.

Half shells 1, 2 are formed so as to have two recesses 11, 21 prolonged in the direction of flat faces 13, 23 by channels 12, 22 opening inside semicylindrical portions 53, 54.

This arrangement permits an accommodating space 7 to be created inside the case when the case is closed, said space opening on the upper face through a hollow cylinder 70 into threaded piece 6.

This space 7 is for accommodating vessel 8 containing the perfume with its neck 80 within cylinder 70.

As shown in FIG. 5, vessel 8 has a shape adapted to be positioned within space 7 and held in place therein.

One will appreciate that the spherical shape of vessel 8 and of space 7 is merely one example of realization.

A fitting made of plastic or elastic material and not shown in the figures can be positioned within portions 53, 54 forming screwing piece 6 to improve the hold on neck 80 of the vessel.

Vessel 8 is dimensioned in such a way that the open end of its neck 80 is on the level of the open end of piece 6. In order to ensure such a position reliably without requiring great precision for the walls of space 7 and for vessel 8, one can provide positioning means shown in FIGS. 3 and 5 in the form of a groove 72 and a bulb 82.

One thus uses the inventive bottle as follows.

After removing cap 3 from the case, one separates half shells 1, 2 from each other with the aid of tongue 56. When the case is open one disposes vessel 8 containing the perfume in one of recesses 11, 21. When doing so, one of course takes care to position the open end of vessel 8 at the level of the end of semicylindrical portion 53 or 54, optionally by means of positioning means 72, 82.

The case is then closed again, enclosing the vessel between half shells 1, 2 with the above-described means ensuring the hold of this closure.

One now need only screw cap 3 onto piece 6. Cap 3 ensures a tight closure of vessel 8 by a packing not shown that is provided at the bottom of bore 36.

Cap 3 likewise ensures that the case is locked in the closed position.

As a variant, cap 3 and piece 6 formed by rings 51, 52 have other connecting means, such as a bayonet catch.

The inventive bottle is enhanced by making half shells 1, 2 of a transparent material, such as cut crystal glass, or a different superior material, such as a plastic material covered with a metal such as gold, silver or platinum.

Skirt 55 forms with its outer surface a decorative ring 5 which masks the holding means. Ring 5 and the cap will preferably be decorated with strass to further enhance the decorative and luxurious appearance of the bottle.

The vessels containing the perfume may be made of a colored material in order to create a play of color within the crystal case. These colors may be provided so as to imitate precious stones.

I claim:

1. A perfume bottle housing for receiving a perfume bottle therein, comprising:

an outer case including two half shells having opposing surfaces which contact each other when said outer case is in a closed position and each said half shell having a flat truncated top surface;

a first and second holding ring means each disposed along a portion of one of said half shells, said first and second holding ring means each including a first portion contacting the flat truncated top surface of one of said half shells, a second portion contacting an edge of one of said half shells, and a semicylindrical portion disposed adjacent to said first portion which forms part of a threaded connection; and a cap threadedly attachable to said semicylindrical portions of said first and second holding ring means for tightly closing the perfume bottle and locking said outer case.

2. A perfume bottle housing as defined in claim 1, said outer case further comprising means for articulating each said half shell about an axis which is tangent with their outer surfaces, and said first and second holding ring means further comprising bearing means for holding said first holding ring means against said second holding ring means when said outer case is in the closed position.

3. A perfume bottle housing as defined in claim 2, wherein the axis is in a plane defined by said opposing surfaces of said half shells.

4. A perfume bottle housing as defined in claim 2, wherein said bearing means operates by friction.

5. A perfume bottle housing as defined in claim 1, wherein said opposing surfaces of said half shells are surrounded by said first and said second portions of said first and second holding ring means.

6. A perfume bottle housing as defined in claim 1, wherein said second portion of said first holding ring means includes a skirt which extends over said second portion of said second holding ring means whereby said skirt acts as a decorative masking ring.

7. A perfume bottle housing as defined in claim 1, wherein a first portion of one of said first and second holding ring means includes a raised tongue means for assisting in opening said outer case.

8. A perfume bottle housing as defined in claim 7, wherein said cap includes an annular chamber for accommodating said raised tongue means.

9. A perfume bottle housing as defined in claim 1, wherein each of said half shells include means defining a recess for accommodating the perfume bottle therein.

10. A perfume bottle housing as defined in claim 9, wherein said means defining a recess includes a portion which is cylindrical in shape and extends toward said semicylindrical portions of said first and second holding ring means.

11. A perfume bottle housing as defined in claim 10, wherein the perfume bottle includes a neck and the bottle is placed in said recess and the neck is disposed in the cylindrical portion of said recess.

12. A perfume bottle housing as defined in claim 11, wherein the perfume bottle and said outer case include means for positioning the perfume bottle in said outer case.

13. A perfume bottle housing as defined in claim 1, wherein said cap includes a threaded bore having packing material at the bottom thereof to ensure a tight closure of the perfume bottle.

14. A perfume bottle housing as defined in claim 1, wherein said half shells are made of a transparent material.

* * * * *